US005509570A

United States Patent [19]

DeMatteis

[11] Patent Number: 5,509,570

[45] Date of Patent: Apr. 23, 1996

[54] DISPENSER OF PLASTIC BAGS

[76] Inventor: Robert B. DeMatteis, 800 E. Washington, Colton, Calif. 92324

[21] Appl. No.: 308,607

[22] Filed: Sep. 19, 1994

Related U.S. Application Data

[62] Division of Ser. No. 995,369, Dec. 23, 1992, Pat. No. 5,348,399.

[51] Int. Cl.[6] ..... B65H 1/04

[52] U.S. Cl. ..... 221/33; 221/47; 221/52; 221/55; 221/63; 221/64; 221/303; 221/305

[58] Field of Search ..... 206/554; 383/209, 383/35; 221/33, 45, 47, 51, 52, 53, 55, 56, 63, 64, 303, 305

[56] References Cited

U.S. PATENT DOCUMENTS

| | | | |
|---|---|---|---|
| 615,736 | 12/1898 | Nagle | 221/55 |
| 1,674,697 | 6/1928 | Olsen | 221/305 |
| 2,101,579 | 12/1937 | Hamer | 221/63 X |
| 3,269,593 | 8/1966 | Lodewick et al. . | |
| 3,395,830 | 8/1968 | Buttery . | |
| 3,420,433 | 1/1969 | Bostwick . | |
| 3,451,453 | 6/1969 | Heck . | |
| 3,606,080 | 9/1971 | Lynch et al. | 221/63 |
| 3,624,791 | 11/1971 | Taub . | |
| 3,765,565 | 10/1973 | Fietzer et al. . | |
| 3,826,361 | 7/1974 | Heckrodt | 221/47 X |
| 3,881,632 | 5/1975 | Early et al. . | |
| 3,986,479 | 10/1976 | Bonk . | |
| 4,044,919 | 8/1977 | Olson . | |
| 4,175,673 | 11/1979 | McDonald et al. . | |
| 4,289,262 | 9/1981 | Finkelstein | 221/63 X |
| 4,363,405 | 12/1982 | Christie . | |
| 4,453,649 | 6/1984 | Origuchi . | |
| 4,506,801 | 3/1985 | Origuchi . | |
| 4,526,291 | 7/1985 | Margulies . | |
| 4,562,938 | 1/1986 | Loder . | |
| 4,567,984 | 2/1986 | Gietman, Jr. . | |
| 4,568,630 | 5/1986 | Loder . | |
| 4,765,508 | 8/1988 | Poppe . | |
| 4,805,800 | 2/1989 | Nocek et al. . | |
| 5,024,349 | 6/1991 | Haenni et al. . | |
| 5,310,057 | 5/1994 | Caldwell et al. | 221/63 X |

FOREIGN PATENT DOCUMENTS

| | | | |
|---|---|---|---|
| 223262 | 5/1987 | European Pat. Off. | 221/63 X |
| 2691697 | 12/1993 | France | 221/45 X |

*Primary Examiner*—William E. Terrell
*Assistant Examiner*—Dean A. Reichard
*Attorney, Agent, or Firm*—Darby & Darby

[57] ABSTRACT

A dispenser having a top surface and a front surface with a cut-out extending between the front and top surfaces with slits extending from sides of said cut-out along the front surface. A stack of plastic bags or plastic sheet pick-up tissues are arranged in the dispenser and are dispensed by grasping an uppermost one via the cut-out and pulling outward with the bags being pulled one at a time through the cut-out and slits. The bags may be sculptured with a wave pattern defining a periphery of the corner regions on either side of the mouth of the bag.

18 Claims, 9 Drawing Sheets

DISPENSER OF PLASTIC BAGS

This is a division of application Ser. No. 07/995,369, filed Dec. 23, 1992, now U.S. Pat. No. 5,348,399.

BACKGROUND OF THE INVENTION

1. Field of the Invention

The present invention relates dispensing container for dispensing plastic bags or pick-up tissue of the type suitable for use in retail, supermarket, and foods outlets, and other related applications. The present invention also relates to a dispenser in combination with the plastic bags.

2. Discussion of Related Art

Conventional plastic bags are of a flush-cut type, which has been commonly used for the past 10–15 years to hold merchandise or food items as is found, for instance, in retail stores, bakeries, supermarkets or hot dells in a foods outlet.

Years ago, before the strong presence of plastic in such outlets, common paper bags were used as the principle packaging means. These bags were typically "baled" in units of about 500. The outlet using the bag would generally place these bags, stacked one upon the other, on a shelf near a cash register at the check-out counter. When the consumer made a purchase, the clerk would close the sale and then place the consumer's purchase in the paper bag.

With the recognition by retailers of the many great attributes and versatility of plastic, including the availability in many colors and with a substantial space savings, more and more retailers began to switch from paper bags to plastic. Unfortunately, plastic bags could not be stacked one .upon;the other due to their slippery nature. When dispensed from the counter in this manner, they would frequently slide onto the floor, and hence be thrown away in the trash.

To help overcome this problem, dispenser cartons were designed with simple, square openings in the front panel of the carton. The user could slip his hand inside the square opening on the carton and withdraw a plastic bag through the opening in the same natural motion as with paper. This carton prevented the naturally slippery bags from sliding onto the floor. These bags in dispenser cartons serviced the industry for several years and usually with a specific cost benefit per unit over paper.

In an effort to reduce costs of cardboard cartons and to reduce throwaway trash in a retail operation, several plastic bag producers began to offer dispenser bags to replace the dispenser carton. These bags typically had a square hole in the front part of the dispenser bag. Typically, the plastic bags were dispensed from the dispenser bag in much the same manner as from the dispenser carton.

However, close observation of dispensing bags from a traditional dispenser box or dispenser bag with the square hole in the front reveals another problem. The problem is that as bags are withdrawn from the dispensers, frequently more than one bag would be extracted by the user. This is due to a few factors. One is the natural tendency of thin gauged plastic bags to stick together, one to another, due to static electricity. Another is that during the-manufacturing process, the bags are frequently stacked one upon the other on pins, hence creating a tendency for the stack of bags to stick together. The phenomena is further compounded when a manufacturer very tightly packs the dispenser box with bags, pushing the bags together and further enhancing the sticking problem.

When a plastic bag is dispensed from a dispenser box or dispenser bag, it is a common phenomena to accidently extract more than one bag at a time. The result of this phenomena is that the extra extracted bags frequently end up being pushed underneath, and to the back, of the check-out counter. Wastage can be substantial.

One method used to help overcome this problem was to pack the bags in the dispenser with the bottoms (bag tails) towards the square opening. This helps to some extent because the user can more easily locate a single bag tail to withdraw. This means of packing bags was only partially effective in reducing wastage upon dispensing. It did, however, create a new problem that is probably more costly to the retail outlet.

If the bags are packed "tail forward", a user requires 4–5 motions to dispense and open the bag. In contrast, if the bags are packed "mouth forward", a user can dispense and open the bag in 1–2 motions. The extra motions associated with the bags packed "tail forward" constitute extra handling required to reposition the bag favorably with the bag mouth upwards to prepare the bag for opening and loading.

With the high cost of labor in developed countries, these added time consuming steps represent a potentially substantial amount in labor costs as well as a decrease in productivity and customer through-put. Thus, packing the bags tail forward has its drawbacks.

Another potential solution to the bag dispensing problem is putting bags on rolls. However, this approach, while reducing the wastage from bags sticking together, creates a worse productivity picture. The motions required to withdraw and remove a bag from a roll generally number about 7–9. The added motions are required to tear a bag from the roll, then reposition it for opening.

Other approaches to overcoming the bag sticking problem and the dispensing problem are such as those bags of U.S. Pat. No. 4,759,639. These dual tab bags, when dispensed from a carton which retains the dual tabs, have a reliable degree of singulation. This means of mounting the tabs on a tab retention device in the carton packing operation has been relatively costly and labor intensive.

A perforation typically used in a bag tab configuration is that described in U.S. Pat. No. 4,759,639. This bag style, when pulled from its tabs, may be vulnerable to tearing at the perforation connection areas. To alleviate this tearing problem, an upwardly pointing tit connection may be provided which causes the tear to be directed into the tab region and away from the bag body. While such a tit connection does tear into the tabs rather than the bag, it leaves unsightly tails attached to the bag. At times, the tit connection may cause tearing across the entire tab, leaving unsightly plastic pieces remaining attached to the bag body.

It would be desirable to provide plastic bags and a container for dispensing the plastic bags which are configured to cooperate with each other so as to reduce the problems of wastage and loss of productivity associated with the use of flush-cut plastic merchandise bags in retail and supermarket outlets. It would also be preferable to increase the likelihood of a clean cut when severing perforations between a plastic bag and its tab.

SUMMARY OF THE INVENTION

One aspect of the invention is directed to a dispenser having a container packed with a stack of plastic bags or pick-up tissue. The container has top and front surfaces. The plastic bags or pick-up tissue may be dispensed one at a time from the carton through a cut-out opening extending between said top and front surfaces and through two slits.

The cut-out opening has a configuration in the top surface which allows for manual grasping of a top-most one of the plastic bags contained within the container. The cut-out is defined in the front surface by a bottom edge and two side edges each extending upwardly and outwardly from a respective side of the bottom edge so as to be configured for channeling the top-most one of the bags along the side edges during dispensement. The two slits each extend outwardly and each has a lower edge extending upwardly and outwardly from a respective one of said two side edges. The top-most one of the bags is channeled to the lower edge as a result of the channeling upward from the side edges. The slits have a configuration which allows dispensement of the plastic bags one at a time through the slits and may block a subsequent bag from being dispensed at the same time through the slits when the subsequent bag clings to the top-most one of the plastic bags during the dispensement.

BRIEF DESCRIPTION OF THE DRAWINGS

For a better understanding of the present invention, reference is made to the following description and accompanying drawings, while the scope of the invention is set forth in the appended claims.

DESCRIPTION OF THE PREFERRED EMBODIMENT

Figure 1:
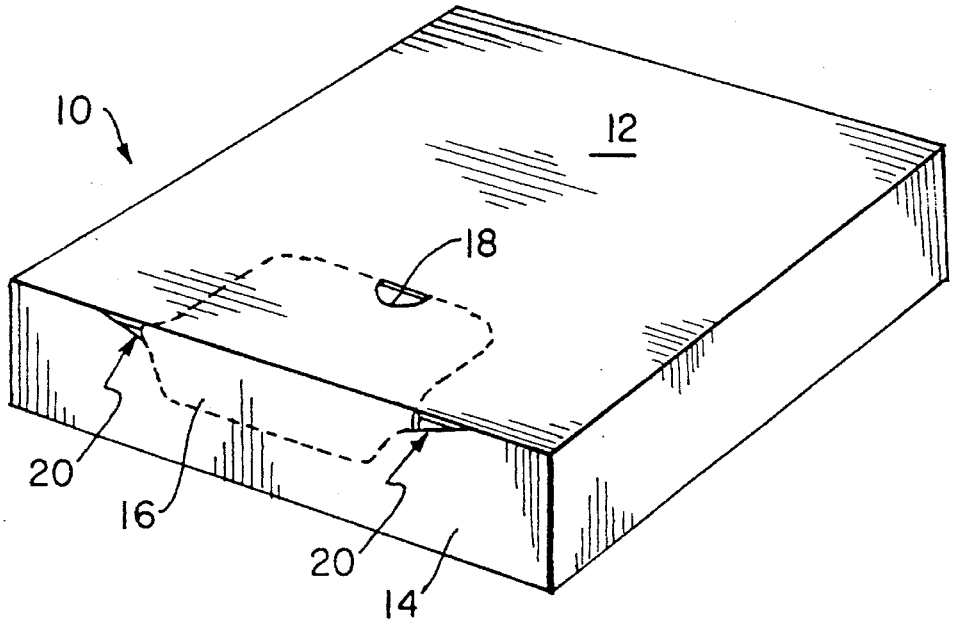
FIG. 1 is a perspective view of the front, top and right side of a closed carton containing plastic bags in accordance with the present invention.

FIG. 1 shows a dispenser container or carton 10 in accordance with a first embodiment. The carton has a top surface 12, a front surface 14 and a perforated portion 16 which extends from the front surface to the top surface. A tab opening 18 may be provided at the boundary of the perforated portion on the top surface to facilitate manual removal of the perforated portion, which is done by tearing at the perforations. On either side of the perforated portion 16 along the front surface 14 is a respective slit 20.

Figure 2:
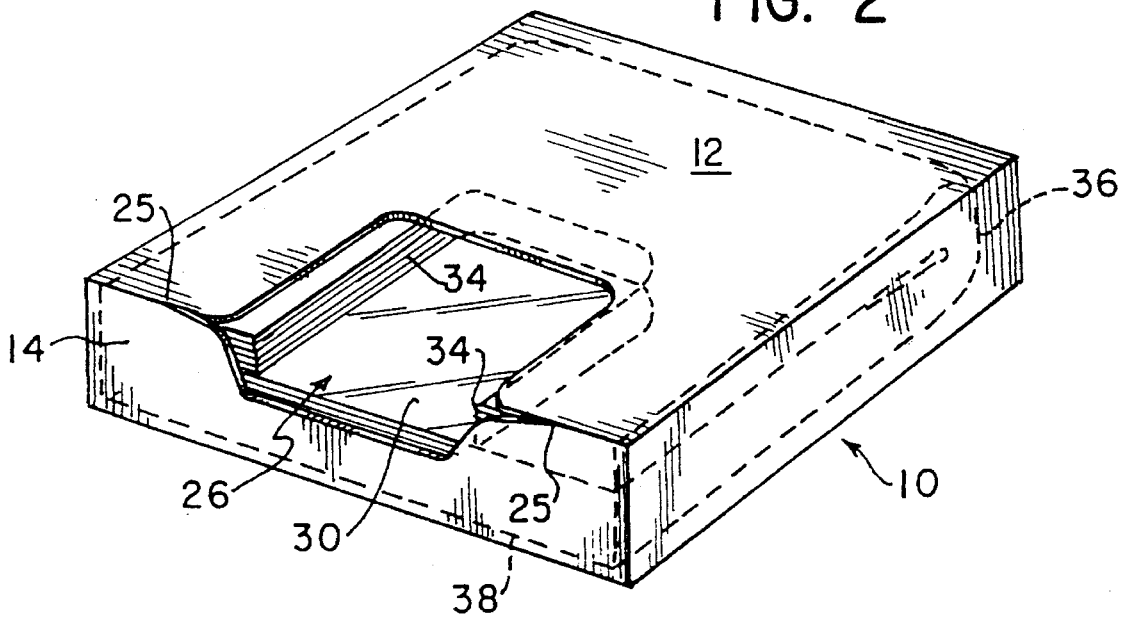
FIG. 2 is a perspective view of the front, top and right side of the carton of FIG. 1 after removing a perforated cut-out-portion. A bottom-loaded stack of T-shirt the plastic bags is shown in phantom.

As can be seen in FIG. 2, the carton 10 contains a stack of plastic bags 30. In the case of the FIG. 2 embodiment, that stack is a tail forward loaded stack of T-shirt type plastic bags. When the perforation portion 16 of FIG. 1 is removed, the opening formed may be considered a cut-out which provides access to the contents of the carton, i.e., the stack of plastic bags contained in the carton.

The carton 10 preferably is a "Regular Slotted Carton" (RSC), which is made out of cardboard. The RSC is exemplified by that manufactured by Stone Container of Chicago, Ill. or Container Corp. with offices in Corona, Calif. These manufacturers also have facilities for making cut-outs in the cartons which enable dispensing of bags in accordance with the present invention. One need only provide these manufacturers with the configuration and dimension of the desired cut-out and they can mass produce the RSC to have such cut-outs. Of course, in accordance with the invention, the carton may instead be any type of container and need not be made from cardboard. For instance, it may be a permanently mounted, metal container which fits under a check-out counter. Also, see the FIG. 10 embodiment.

The cut-out itself extends between the front and top surfaces of the carton. Its shape in the top surface is not particularly important so long as it allows a user's hand to enter for grasping the bags. However, the shape of the cut-out in the front surface of the carton does affect whether just one bag at time or several bags simultaneously are dispensed by the user during each dispensing motion by the user. Therefore, proper selection of the configuration of the cut-out becomes important if only one bag at a time is to be dispensed. By promoting the dispensing of only one bag at a time, such a cut-out helps alleviate the problems of wastage and productivity in foods outlets otherwise caused when multiple bags are dispensed at the same time which must be separated.

The cut-out design for the carton 10 of the present invention is intended to take into account the natural dispensing motion of the user. Such a natural dispensing motion involves a user reaching down, grasping a bag in an initially downward "swipe" then after grasping the end of the bag, pulling it out and upward.

In order to counter the tendency of the user to pull out multiple bags simultaneously, the cut-out design of the present invention is provided with slits, extending from both sides of the cut-out. The slits in effect "pinch" a subsequent bag in a stack that might otherwise cling to the bag being dispensed. In so doing, the subsequent bag is effectively blocked or prevented from dispensing simultaneously with the intended bag being dispensed.

Figure 3:
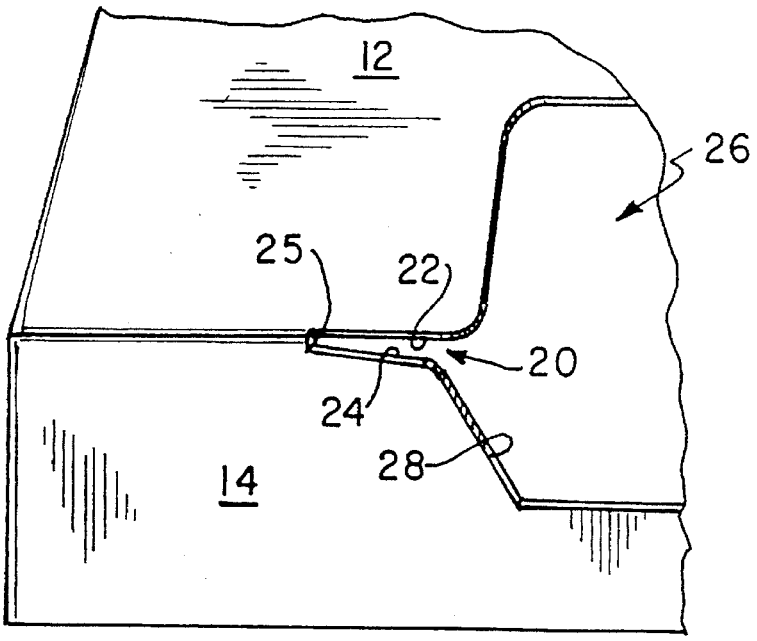
FIG. 3 is an enlarged partial perspective view of the front and top of the left side of FIG. 2, which mirrors the right side.

As seen in FIG. 3, each slit 20 preferably is configured with a flat top edge 22 and a lower edge 24 which extends upwardly and outwardly from the slanted side 28, which defines a portion of the cut-out 26 in the front surface of the carton. The slanted side 28 extends upwardly and outwardly from the bottom edge of the cut-out opening. This lower edge 24 of the slit may curve convexly for a smoother transition from the slanted side 28. FIG. 3 is a partially broken view; however, the left side (not shown) is symmetrical to that of the left (see FIG. 2). When a top bag is being dispensed, the bag has a tendency to bump into the flat top edge 22 so that the body and tail of the bag have no choice but to follow behind and be fed through the slits.

Figure 4:
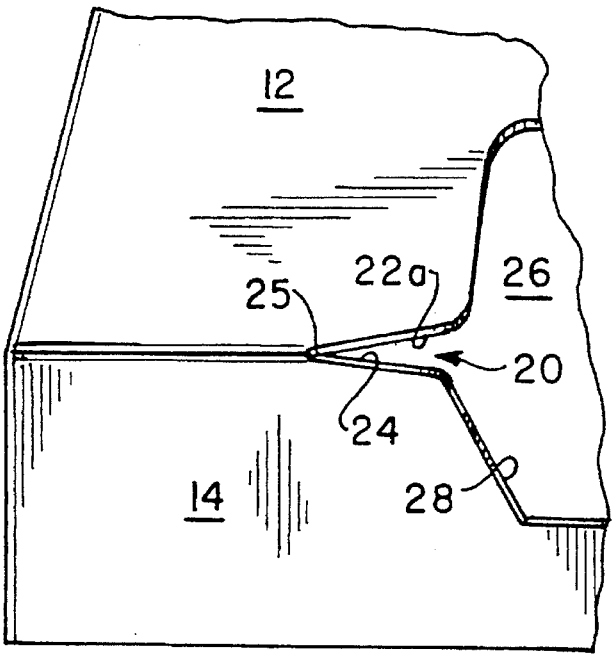
FIG. 4 is the same view as in FIG. 3 but for another carton embodiment.

The FIG. 4 embodiment is the same as that of the FIG. 3 embodiment except that the top edge 22*a* tapers in the top surface 12, rather than extending flat along the edge between the front and top surfaces as in FIG. 3.

Figure 5:
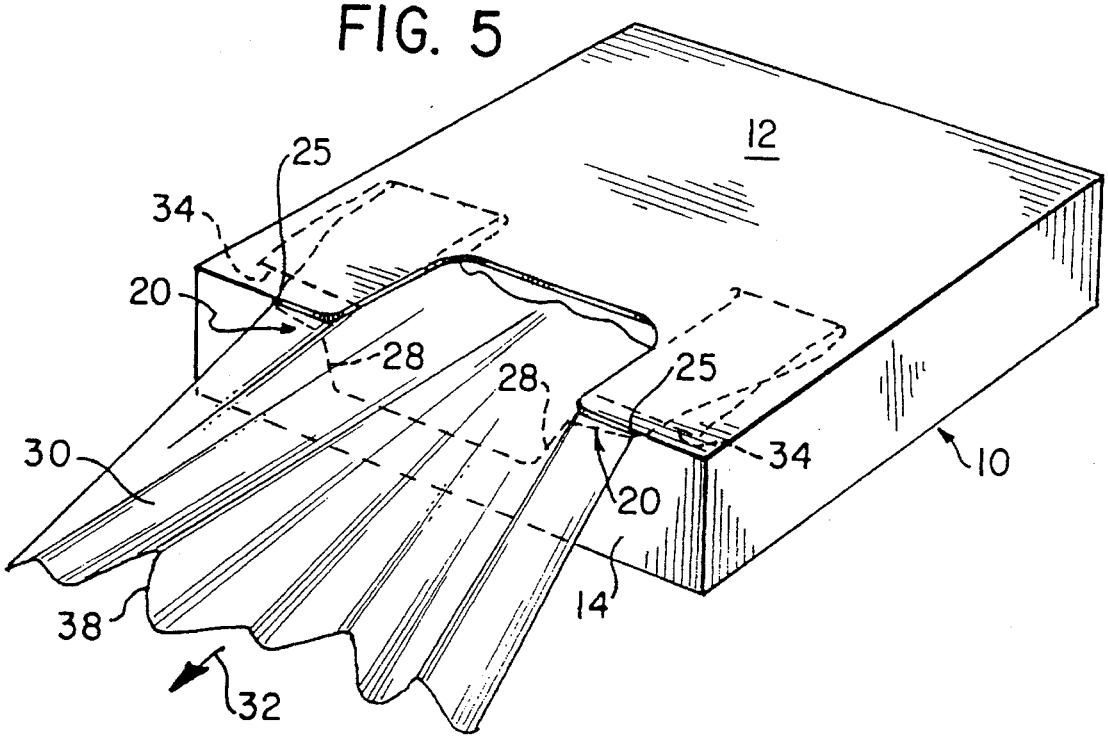
FIG. 5 is a perspective view of the carton as in FIG. 2 but with a top-most tail forward T-shirt type plastic bag being pulled out of the carton.

FIG. 5 shows one of the tail forward T-shirt bags 30 being pulled out of the carton in the direction of the direction arrow 32. In this case, the bottom or tail end 38 comes out first, while the straps 34 come out last. As can be better seen in FIG. 2, for tail forward dispensing, the T-shirt bags are arranged in the carton such that they are folded in half widthwise in the carton with the fold 36 toward the rear of the carton. In this manner, the stacks of straps 34 are adjacent the cut-out 26 and lie on top of the stacked bottom or tail end 38 of the plastic bags.

When dispensing the tail of the top-most T-shirt bag of FIG. 2 from the stack, sides of the bag are forced to channel upwards into the slits 20, because of the upwardly and outwardly slanted sides 28 and then along with the tapering lower edge 24 of the split. A subsequent bag attempting to stick to this topmost bag during the dispensing will resist this upward channeling. If this subsequent bag continues to stick, however, it will be pinched by the slit at the outer end 25 and so will cease to dispense further.

As can be seen in FIG. 5, the bag sides have channeled completely through the slits. A subsequent bag which might otherwise stick to this bag is left behind in the carton, ready to be dispensed as the next bag in the same manner just described.

Figure 6:
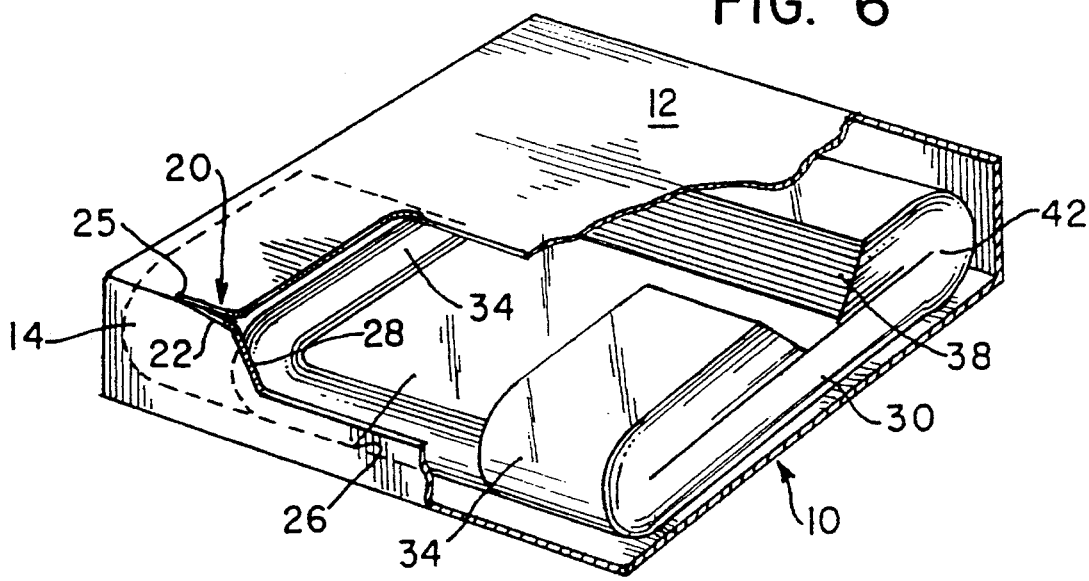
FIG. 6 is a perspective view of the carton as in FIG. 2 but with a portion of the carton broken away to reveal the contents; the contents in this embodiment are a mouth forward loaded stack of T-shirt type plastic bags.

FIG. 6 shows the stacking of the plastic bags 30 in a position for mouth forward dispensing. As can be seen the bags are folded at two locations; the first is a fold 40 at the straps' juncture with the rest of the bag and the second is a fold 42 closer to the bottom (about halfway) at a location which permits each fold 40, 42 to lie against the front and rear walls of the carton, which helps keep the stack of plastic bags in position within the carton between the front and rear walls. The fold 40 results in the straps 34 being folded to extend away from the cut-out 26 and toward the other fold 42. The bags are now positioned to expose the top-most mouth in the stack, which is in a forward-most position immediately accessible via the cut-out 26.

Figure 7:
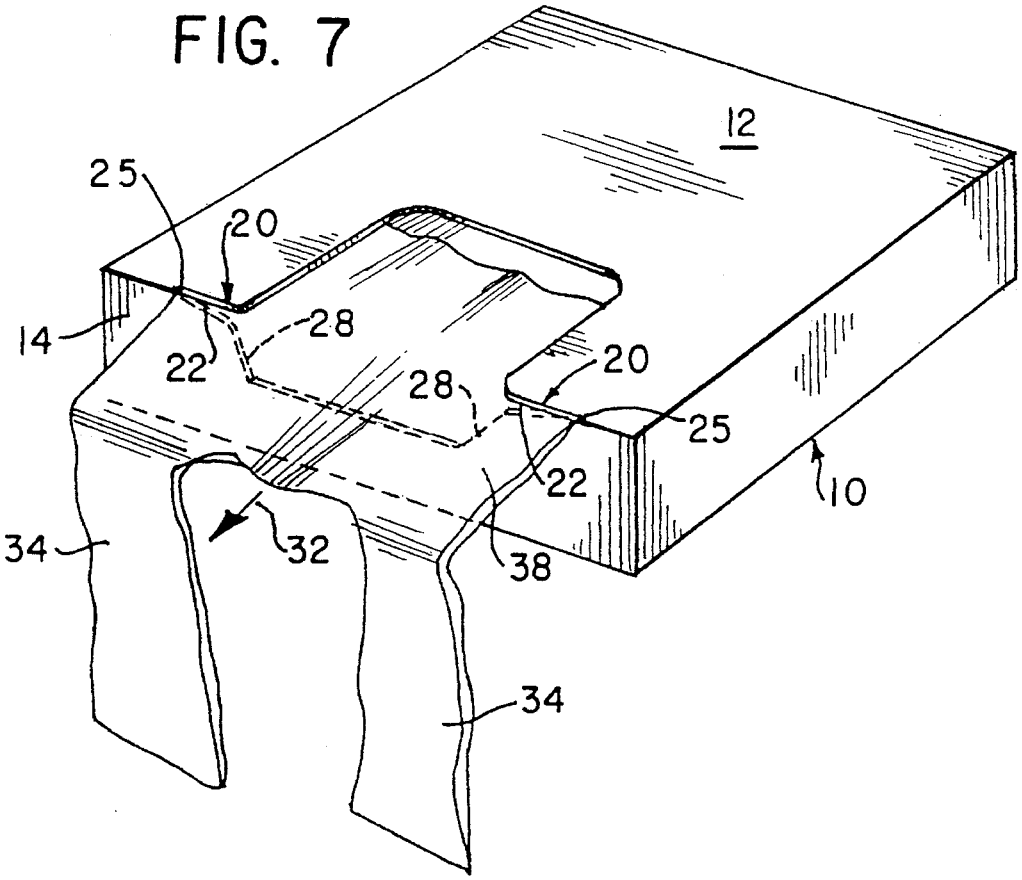
FIG. 7 is a perspective view of the carton as in FIG. 6 but with a top-most mouth forward plastic bag being pulled out of the carton.

FIG. 7 shows the result while pulling the top plastic bag out of the carton in the direction of direction arrow 32 when the plastic bags are stacked in the mouth forward loading arrangement of FIG. 6. The straps 34 of the T-shirt plastic bag emerges from the carton before the bottom or tail-end 38 of the bag (see FIG. 6).

Figure 8:
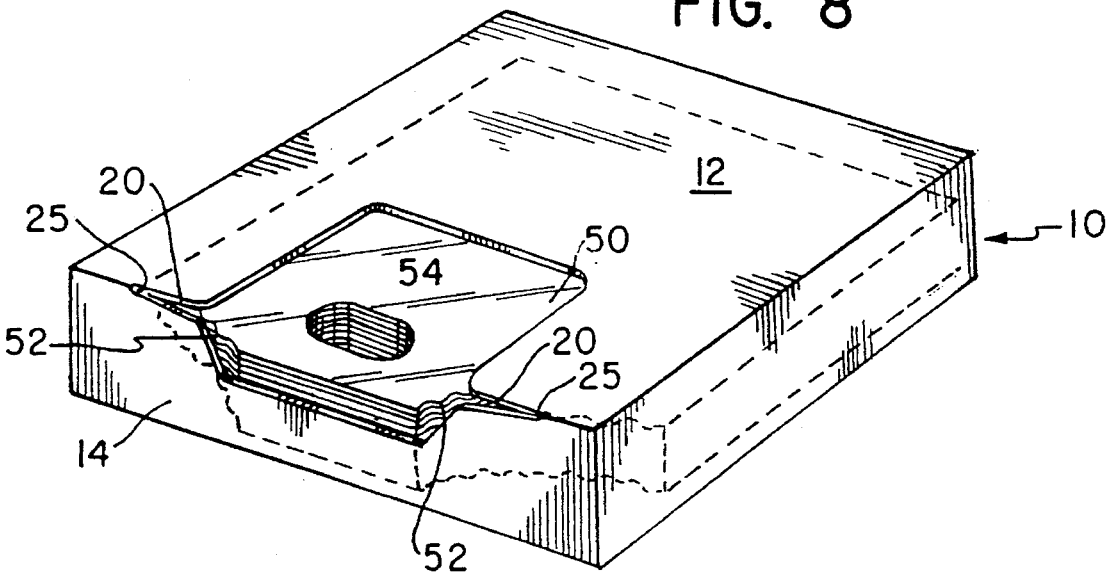
FIG. 8 is a perspective view of the carton as in FIG. 2 but which contains a mouth forward loaded stack of sculptured plastic bags in accordance with 3let another embodiment of the invention.
Figure 9:
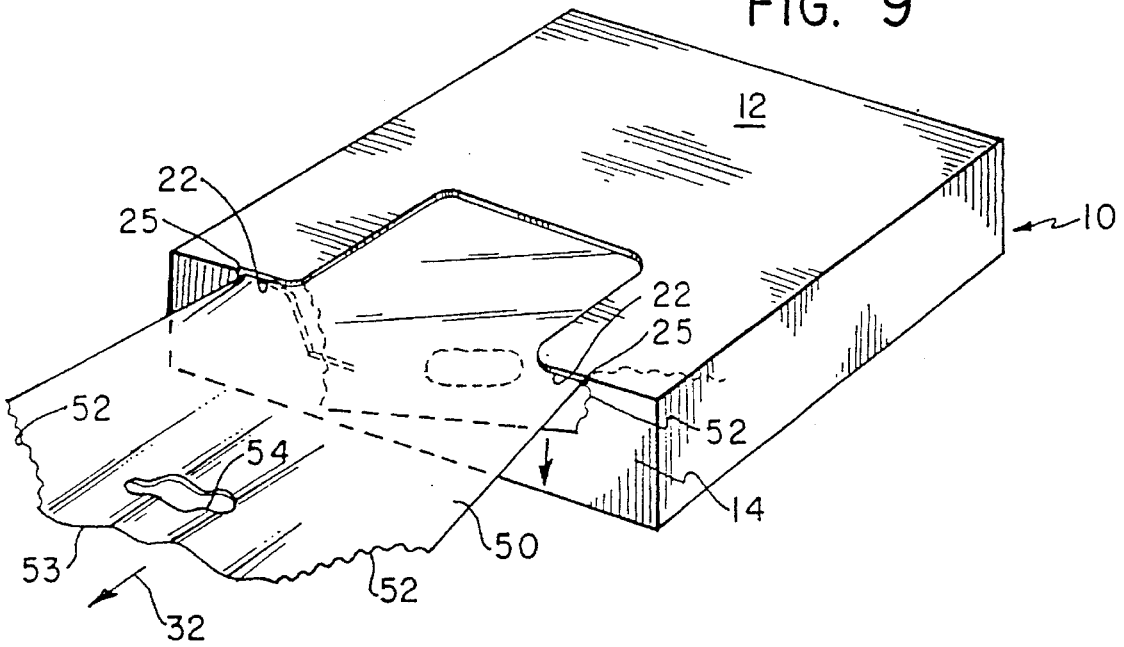
FIG. 9 is a perspective view as in FIG. 8 showing a top-most mouth forward sculptured plastic bag being pulled out of the carton.

FIGS. 8 and 9 show the same carton in use as for the other embodiments. However, a stack of uniquely "sculptured" plastic bags 50, instead of T-shirt bags, are contained within the carton and lie flat. The phrase "sculptured" plastic-bag is intended to refer to a type of plastic bag which has a mouth with a top edge at the top, a tail at the bottom, two sides extending from the tail to an elevation lower than the top edge of the mouth, and two edge configurations each extending from the top of a respective one of the sides to the top edge. The two edge configurations are an extension of the mouth since there are no upper shoulders at the same elevation of the top edge of the mouth.

As can be better seen in FIG. 9, two edge configurations 52 each extend from a respective side of the top straight edge 53 of the mouth of the sculptured bag and are each sculptured or cut with dies to have a wave form cut, resembling either a scallop, saw tooth or sinusoidal pattern. Each sculptured edge configuration generally curves downwardly and outwardly to a respective side of the bag. Spaced from and between these sculptured edge configurations may or may not contain an oval opening 54 which serves as a handle, spaced from the top straight edge 53 of the mouth opening. Such oval openings are known.

When pulling the top-most bag out of the carton in the direction of the direction arrow 32, the top-most bag channels upward along the slanted sides 28 and into the slits 20. If a subsequent bag clings to the top-most bag during this channeling movement, the edge configurations of this subsequent bag snags in either or both apexes 25 of the carton, which prevents the simultaneous removal of the subsequent bag together with the top-most bag.

Figure 10:
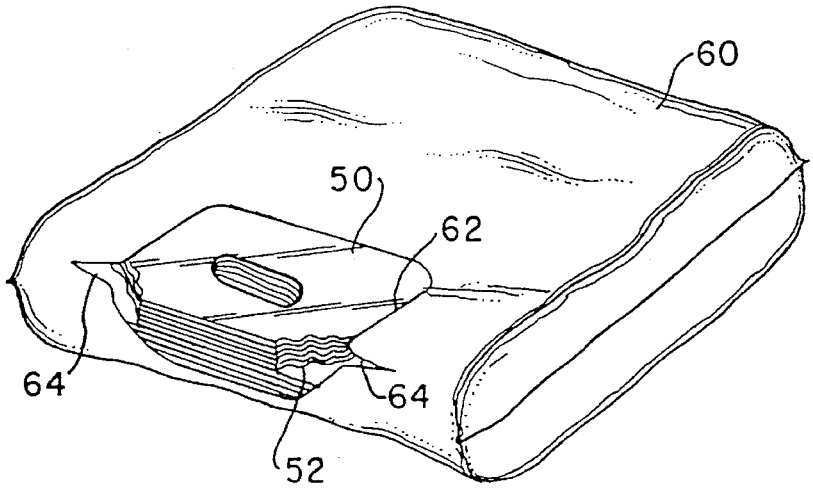
FIG. 10 is a perspective view of a front, a top and a left side of the sculptured plastic bags of FIGS. 8–9 contained within a dispenser bag in accordance with still another embodiment of the invention.

FIG. 10 shows a stack of the sculptured bags 50 contained within a larger plastic dispenser bag 60, which has a cut-out 62 and slits 64 whose shape is identical to the cut-out 26 and slits 20 in the carton 10. The dispenser bag 60 may be made from any high density plastic film. The bag 60 includes a removable plastic perforated portion (not shown) which forms the cut-out 62 when removed from the front and top surfaces by tearing along its perforations.

Figure 11:
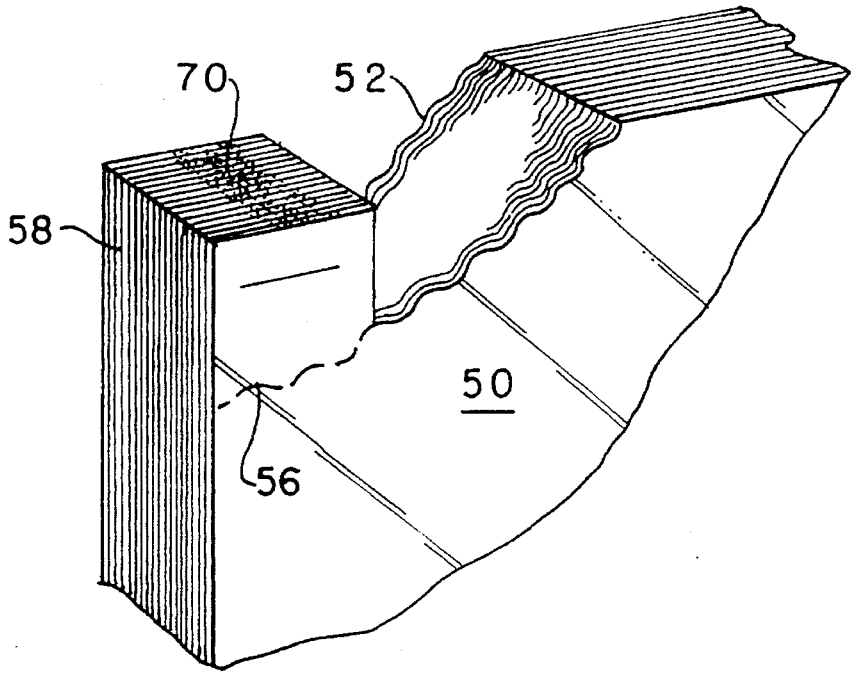
FIG. 11 is a perspective view of the embodiment of the plastic bags of FIG. 8 except that attached end tabs are provided.

FIG. 11 depicts the upper left side of a dual tab embodiment which is the same as the "sculptured" bag embodiment of FIGS. 8–10, except that perforations 56 are provided which separate tabs 58 from the rest of the bags. This perforation 56 is cut as a continuation of the scallop shape and, when severed, will result in the bag resembling the sculptured bag embodiment exactly. Examples of suitable perforating rules include any from 2 teeth per inch to 12 teeth per inch or with a tooth size of from 1/32 inch to 1/2 inch with a 1/32 inch to 1/8 inch spacing between adjacent teeth.

Figure 12:
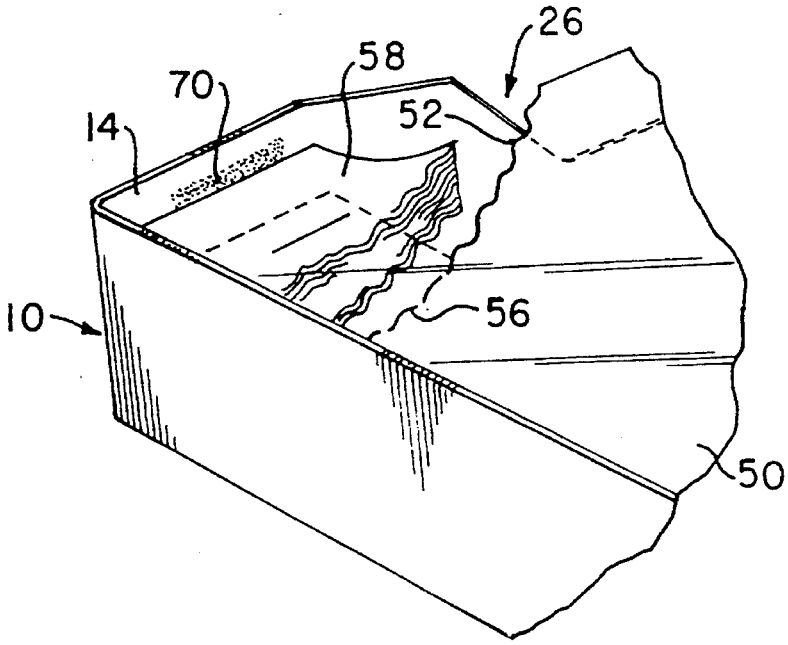
FIG. 12 is a partially broken view of the plastic bags of FIG. 11 contained within a carton of FIG. 2, but with the tabs secured to an inside surface of the carton and with an upper tab severed from its associated top-most bag which results from pulling the top-most bag out of the carton.

On a top edge of the stacked tabs 58 is an adhesive 70, such as an epoxy or hot melt. As can be seen best in FIG. 12, this adhesive 70 is pressed against an inner facing side of the front surface 14 of the carton 10 to securely adhere the tabs to the carton. FIGS. 11 and 12 only show the upper left hand side of the stack of bags; the upper right hand side is configured as a mirror image of the upper left hand side.

When pulling the top-most one of the bags 50 through the cut-out 26, the perforations 56 at both the upper left and right hand sides sever, leaving the top tabs adhered to the carton. When dispensing the bag by pulling it through the cutout 26 of FIG. 12, the scalloped shape contributes to the dispensing of the bags one at a time.

Figure 13:
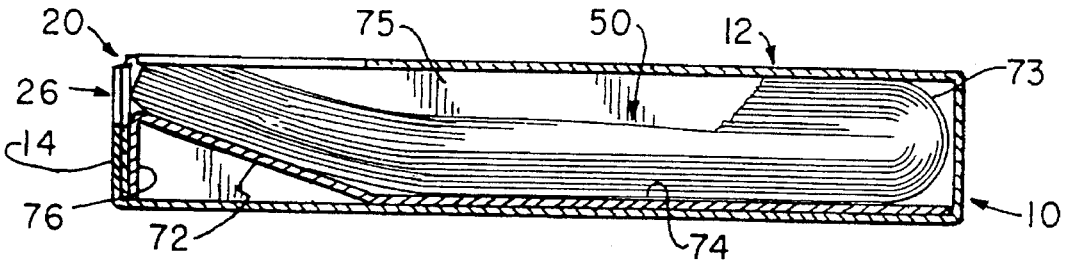
FIG. 13 shows a longitudinal elevation cross-section of the FIG. 8 embodiment, except with a ramp added inside the carton.

As shown in FIG. 13, a ramp 72 may be arranged to extend the full width of the carton and to incline downwardly from approximately the bottom edge of the cut-out opening 26 in the front surface 14 and towards the rear of the carton approximately 1/3 to 1/2 the carton distance. The ramp helps promote dispensement of bags one at a time by helping to channel the bags upwardly and into the slits 20 and by keeping the forward-most end of the bags in an easily reached location for grasping.

As used in FIG. 13 with folded plastic bags, the ramp 72 is particularly effective in promoting easy dispensing of each one at a time, even where such bags are big or long such as those 30 inches to 36 inches long in length. Obviously, cartons of those dimensions (30–36 inches in length) will not fit under typical check-out counters, which typically have enough space for a box of up to a length of about 22 to 26 inches.

The ramp angle of inclination is preferably relatively soft, such as 10 to 15 degrees. This is because with a steep incline, the bags would have a tendency to slip down and away from the user. In order to keep the ramp 72 from sliding inside the box and to dispense with adhering the ramp in the carton, the ramp has a flat portion 74 extending along the bottom of the carton from the base of the ramp incline to the rear of the carton. Also, the ramp has a panel 76 which extends vertically downward from the top of the ramp incline to the bottom of the carton to keep this top of the ramp raised off the bottom. Rather than insert a ramp into the carton, the bottom forward-most flap of the carton itself may be prefolded to provide for such an incline afforded by the ramp.

The bags shown in the FIG. 13 embodiment are exemplified by either flush-cut or sculptured plastic bags 50 packed mouth or tail forward or else T-shirt style plastic bags 26 packed tail forward within the carton. Their fold 73 is adjacent the rear of the carton. Due to the curvature of the fold, the end of the bags spaced away from the cut-out tend to shingle one over the other. T-shirt style plastic bags may also be packed in mouth first as in FIG. 6; the strap handles would extend into the empty space 75 in the carton of FIG. 13.

Figure 14:
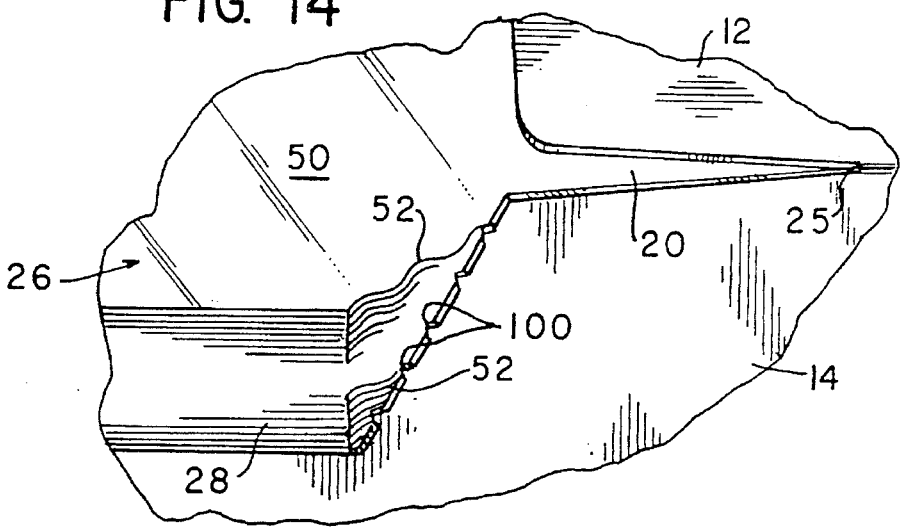
FIG. 14 shows a front plan view of a perforated portion of another carton embodiment.

As a further variation of the carton, FIG. 14 shows slanted sides 28 of the cut-out in the front surface of the carton of FIG. 3 having a sawtooth or sinusoidal wave configuration 100. Such a configuration helps in the "snagability" of subsequent bags during dispensement. Such a configuration 100 results after pulling off a perforation portion 16 (FIG. 1) which is further modified to have perforations punch cut which complement the configuration 100, with the connection tits located at the apexes of the valleys of the wave configuration. In FIG. 14, a stack of sculptured bags 50 is shown visible through the cut-out 26 in the carton, each bag having the sculptured edge configuration 52.

The scalloped cut of the sculptured bags of FIGS. 8–11 may be formed by using a metal rule material, such as that manufactured by U.S. companies of Helmold, Simonds or Wagner. This material is then shaped into an appropriate die shape, such as may be done by Dietec, Inc. of Chicago, Ill. Once the die is made, the bags are cut in accordance with a conventional die cutting process, such as that which utilizes a Universal Cutting Table as made by Amplas, Inc. of Green Bay, Wis. or by a clicker press such as that manufactured by H. Schwabe, Inc. The die consists of sharp metal blades formed and inserted in a wooden board.

Examples of suitable wave rules for cutting the wave form shape of sculptured bag include the 1½ point coarse angle, 2 point scalloped wave rule, and 2 point coarse wave rule as manufactured by J. F. Helmold, Inc. Other examples are a 2 point coarse edge wave rule as provided by Simonds and, for smaller sculptured bags, a 2 point medium edge rule cut as provided by Simonds. Further examples are the 0.937 inch high 2 point coarse, the 0.937 inch high 3 point medium, and the 0.937 inch and 1⅛ inch high 3 point fine edge wave rule as provided by Wagner. This list of examples is not intended to be exhaustive or to limit the invention to these specific examples.

When wave rule is used with tabbed sculptured bags, the lighter the film gauge of the high density film to be cut, the more important it is to have a narrower gap between perforations. Without a sufficiently narrow gap, the thin gauge film will follow the path of least resistance during separation of the bag from the tab, which may result in a straight line tear. The preferred gap distances are as follows: for gauges of about 0.00045 to 0.00065, a gap of 0.32; for gauges of about 0.00065 to 0.001, a gap of 0.45; and for gauges above 0.001, a gap of 0.60.

The wave frequency obtained will fall into one of three categories: under 2 waves per inch (low), 2 to 3¼ waves per inch (medium), and 3¼ to 6 waves per inch (high). As a general rule, the higher the frequency of the wave rule pattern, the narrower the spacing between adjacent teeth. For medium wave frequency, the same preferred spacing distances apply as mentioned previously for the different gauges, except that for the Simonds 2 point medium coarse, a spacing of 0.45 for 0,00065 to 0.001 gauge and a spacing of 0.60 for over 0.001 gauge is preferred. For high wave frequency, 0.32 spacing is preferred for all gauges or even a smaller spacing may be used for gauges 0.00045 to 0.001. For low wave frequency, 0.38 spacing is preferred for 0.00045 to 0.00065 gauge; 0.52 spacing is preferred for 0.00065 to 0.001 gauge and 0.7 spacing is preferred for gauges over 0.001.

The wave rule for cutting the wave form pattern may be a double-sided blade with each side sharpened, as in the case for the previously mentioned Helmold wave rules. Two modifications of this wave rule blade are depicted as embodiments in FIGS. 15, 16 and 17, 18.

Figure 15:
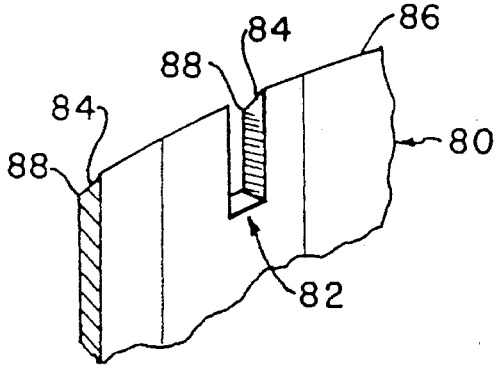
FIGS. 15 and 16 show top and perspective views, respectively, of a wave rule blade in accordance with an embodiment of the present invention.
Figure 16:
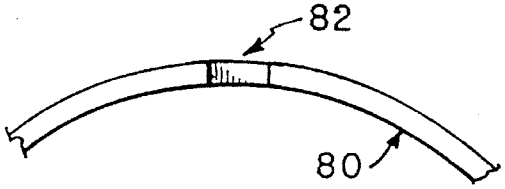

FIGS. 15 and 16 show a wave rule blade embodiment in which the double-sided blades of Helmold's wave rules are replaced by a single-sided blades 80 on either side of a gap 82. In, this embodiment, the end face 84 of each blade inclines in the same direction across the entire end face. This contrasts with a double-sided blade in which there are inclines in different directions mirroring each other on either side of the middle of the end face. In use in forming perforations as in the FIG. 11 embodiment, the sharp outward-most edge 86 of the end face is adjacent the bag while the other edge 88 more inward from the incline is adjacent the tab.

Figure 17:
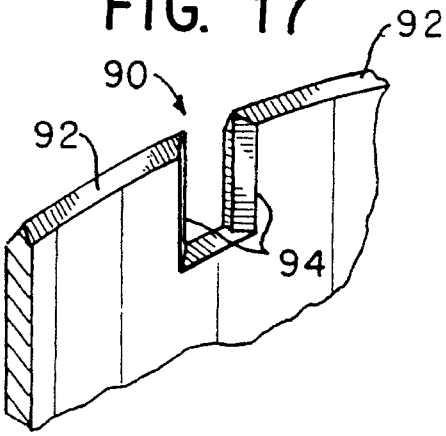
FIGS. 17 and 18 show top and perspective views, respectively, of a wave rule blade in accordance with another embodiment of the present invention.
Figure 18:
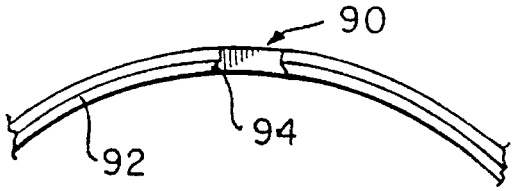

FIGS. 17 and 18 show another wave rule embodiment in which the spacing or gap 90 between adjacent double-sided blades 92 is of a different configuration than that of the Helmold wave rules. A portion of side blade edges 94, which face each other in Helmold's wave rules to define a boundary of the spacing or gap 90, are modified by grinding them with a hand grinder to widen one side 96 to the configuration shown. A fine emery wheel (sandpaper type emery cloth) of about ¾ inch diameter was used for the hand grinder (for example, a hand grinder as manufactured by Dremel). Each side blade edge 84 now inclines outwardly at this one side instead of remaining straight as in Helmold's wave rules. In use in forming perforations as in the embodiment of FIG. 11, the wider side of the spacing should be adjacent the bag, rather than the tab.

After forming the perforations by cutting with the wave rule blade embodiments of either FIGS. 15, 16 or 17, 18, the bag may be separated from its tabs by pulling at the perforations, which have a wave form configuration of peaks and valleys. As a result of having cut as recommended with either the single-sided blade or double-sided blade with one side of the perforation widened as shown in these embodiments, the connection tits between the perforations are cleanly severed; potential tearing other than directly between perforations would tend to be into the tab, rather than into the bag.

A comparative study of the sculptured bag embodiment has been conducted, that is, for bags with and without the scallops. The phrase "singulation" refers herein to the desired goal of dispensing the bags one at a time.

The scallops on the sculptured bag provide a scalloped effect which tends to cause the bag to stick to (snag on) the carton dispenser opening, and hence channel forward and upward into the slits. As a result, the scalloped effect promotes singulation.

In contrast, where the sculptured bag has a smooth cut (a smooth curved cut in place of a scalloped cut), the bag tends not to snag as well. As a result, there is a tendency for the thin plastic film to "fold over" without channelling through the slits; hence there is less tendency for bag singulation.

There are two other attributes to the scalloped effect. The "snagging" effect improves the likelihood of the bag mouth to open up upon being dispensed. This is virtually non-existent without the scallop effect.

Another benefit of the scalloped effect is it aids in preparing the "next bag" for future dispensing. This too is virtually non-existent with a smooth sculptured bag.

Bags were tested with a very high degree of static electricity which would magnify significantly the ensuing sticking problem caused by the static electricity (e.g., static cling). Such a sticking problem would ordinarily be lessened under proper manufacturing procedures.

All of the following bags tested were the same light gauge (0.00045) bags, containing approximately the same very high degree of static electricity. This causes a high degree of cling and a tendency of the bags to want to adhere to one-another. Tabulated in the test results are the number of dispenser failures and the number of bags dispensed as a result of the failures.

Three types of bags, put up in six combinations were tested. They were conventional flush top bags, sculptured bags, and dual tab sculptured bags fixed inside the carton of the embodiment of FIGS. 1–4. The sculptured bags with scalloped shoulders are those of the type shown in FIGS. 8 and 9. The sculptured bags with smooth shoulders are similar except that the wave form edge configuration 52 of FIG. 9 is replaced by a smooth curve. The results are set forth in Table I below.

TABLE I

| BAG STYLE | In Percentages: MULTIPLE BAGS No. DISPENSED | OCCURRENCES |
|---|---|---|
| A. * Control carton (flush top prior art bags). | ** | ** |
| B. Conventional flush top bag. | 68.8 | 25 |
| C. Sculptured bag with smooth shoulders. | 36 | 20 |
| D. Sculptured bag with scalloped shoulders. | 30.8 | 15.4 |
| E. Dual tab Sculptured bag (smooth) fixed inside carton. | 33.4 | 16.7 |
| F. Dual tab Sculptured bag with scalloped shoulders. | 26 | 13 |

* The control carton used standard flush top prior art bags in its standard carton size.
** Too difficult to assess. Repeated attempts resulted in quantities of as many as 26 bags stuck together on a single dispensing. Although these bags were put back in and tried again, there was only limited success in dispensing a single bag at a time.

The results from these tests indicate:

The carton of FIGS. 1–4 significantly improves dispensing conventional flush top bags. Dispensing from the carton of FIGS. 1–4 is further significantly enhanced when a sculptured bag is used. Although the number of multiple occurrences dropped by only 20%, the total number of multiple bags dispensed dropped by 47.6%.

The scalloped effect on the sculptured bag improved dispensing further. It reduced the number of multiple bags erroneously dispensed by 14.4% and lowered the number of occurrences by 23%.

The use of dual tabs improved the dispensing another 10–20% when the tabs of the bags were affixed inside the carton corners.

Dispensing of the sculptured bags from conventional cartons (lacking slits) was tested and the results are in Table II below.

TABLE II

| BAG STYLE | MULTIPLE BAGS # DISPENSED | OCCURRENCES |
|---|---|---|
| G. Sculptured bag in carton without slits. | 93.1% | 20% |
| H. Sculptured bag in a carton with a Sawtooth cut-out but w/o the channeling effect or Slit. | 50% | 18.1% |
| I. Dual tab dispensed from carton without slits. | 41.8% | 16.3% |

* Sculptured bags had the wave pattern scallop.

These test results tend to show that the sculptured bag with the wave pattern improved dispensing in conventional cartons (without the slits) over conventional bags without the sculptured wave pattern. At least there were a few bags that dispensed singly in the conventional carton, but the cut-out opening on the conventional carton does nothing to promote singulation of the dispensing.

However, the snagging effect by the sculptured bag with the wave pattern on a conventional carton without slits, but with a sawtooth opening added in accordance with the invention, did help. The bags snagged better than the conventional bags without the sculptured wave form. In this test, the carton did not have slits and its side edges did not incline outwardly to provide a channeling effect.

The dual tab bags in a prior art carton dispensed at about the same incidence level as a dual tab bag in the carton of the present invention, but the number of multiple bags dispensed increased.

Figure 19:
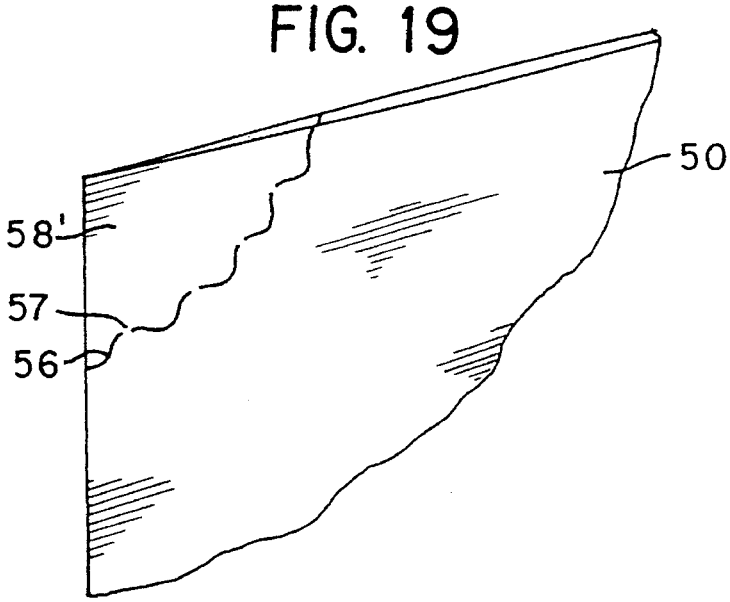
FIG. 19 is a partial perspective view of an upper left corner area of a plastic bag in accordance with another embodiment of the invention, which mirrors the upper right corner area of the bag and is similar to the embodiment of FIG. 11.
Figure 20:
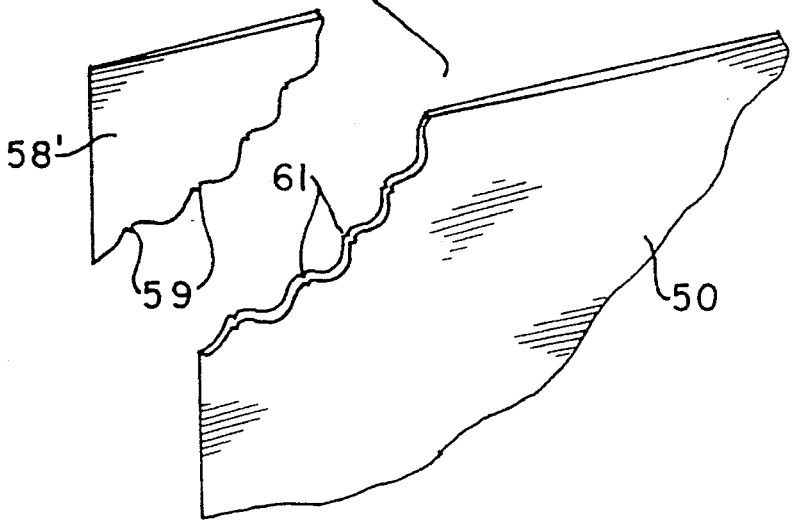
FIG. 20 is a partial perspective view of the same view as FIG. 19 except after severing the upper left corner tab from the rest of the bag.

FIGS. 19 and 20 are successive views showing the result of pulling off a plastic bag from its corner tabs by tearing its perforated wave form pattern. The result is a sculptured bag with a two edge configurations each being clean cut and having a wave form with peaks and valleys. The edge configurations extend from a top edge of the mouth to respective sides of the bag.

When dispensing one bag at a time from a stack of bags, pulling each bag off from corner tabs 58' (FIGS. 11–12) helps to ensure that only one bag is taken at a time. The perforated wave pattern of peaks and valleys separates the tab 58' from the rest of the bag. This pattern consists of perforations 56 and tit connections 57 at the apex of the peaks and may be a sine wave pattern, a saw tooth pattern or a scalloped pattern. After severing the wave pattern perforations, these tit connections appear as small nibs 59 or small recesses 61.

When the bag 50 is pulled relative to the tabs 58', the tit connections 57 sever, thereby leaving each tab 58' separated from the bag 50 in the manner generally shown in FIG. 20. This severing takes place directly across the peaks with little chance of tearing into the bag 50 or upwardly into-the tab 58'. As such, the cut is relatively 'clean' so that after severing, no unsightly tears or tails appear attached to the bag.

Conventional tabs are attached to bags by a perforated curved line extending from each end of a bag mouth to a respective side of the bag. When the bag is pulled with respect to the tabs, the perforated curved line severs, leaving the tabs separated from the rest of the bag. Unfortunately, the severing is not always clean.

Instead, the bags or tabs are vulnerable to tearing or ripping at the perforation connections. Even if tit connections are provided between the perforations which point upwardly towards the tab and thereby prevent tearing or ripping of the bags, the severing at the perforations still may leave unsightly tails extending upwardly where the tab used to be. In some cases, pulling the bag from the tabs so as to sever at the perforations may even tear up the entire tab leaving pieces of unsightly plastic from the tab still attached to the body.

Figure 21A:
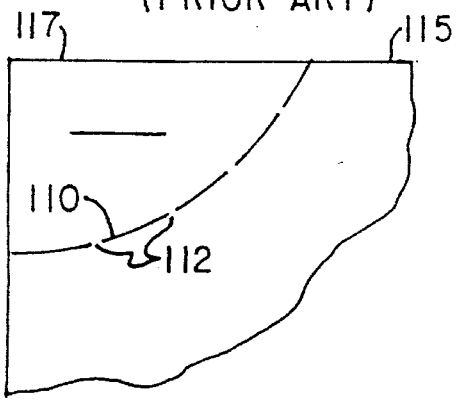
FIG. 21a (PRIOR ART)
FIG. 21*a* is schematic representation of a conventional plastic bag with perforations between a tab and the rest of the plastic bag.
Figure 21B:
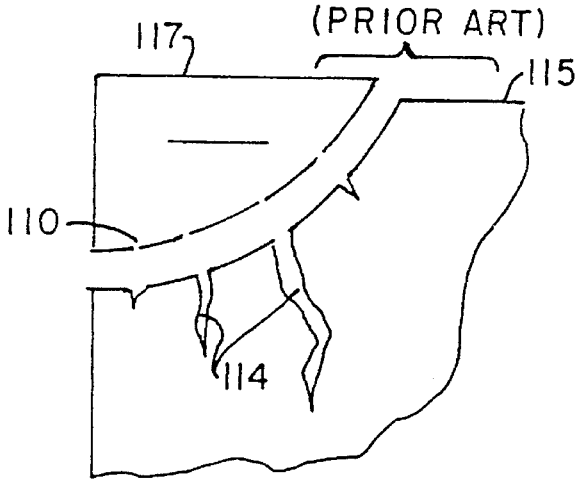
FIG. 21b (PRIOR ART)
FIG. 21*b* is a schematic representation of the plastic bag of FIG. 22*a* after severing the perforations.
Figure 22A:
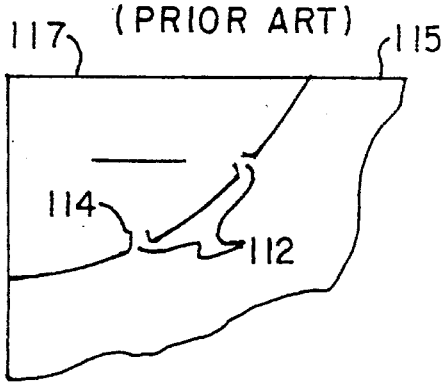
FIG. 22a (PRIOR ART)
FIG. 22*a* is a schematic representation of another conventional plastic bag with perforations between a tab and the rest of the plastic bag.
Figure 22B:
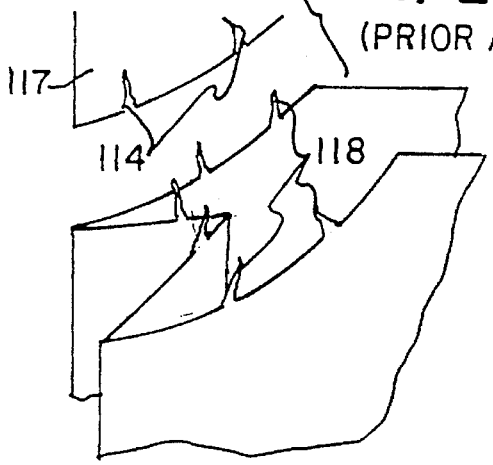
FIG. 22b (PRIOR ART)
FIGS. 22*b*, 22*c* are different schematic representations of the plastic bag of FIG. 22*a* after severing the perforations.

As illustrated in FIGS. 21*a*, 21*b* and 22*a*, 22*b*, 22*c* one can see the consequences of leaving perforated connections vulnerable to tearing. FIGS. 21*a*, 21*b* show the perforation line 110 which has vulnerable points 112, i.e., those most susceptible to tearing in an unclean manner in the form of tears 114 into the bag 115 itself. FIGS. 22*a*, 22*b* show a conventional modification with upwardly pointing tit connections 116 which ensure that the tears 114 are into the tabs 117 rather than into the bag itself.

Figure 22C:
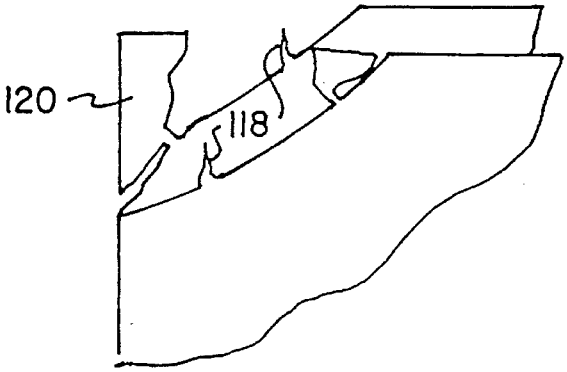
FIG. 22c (PRIOR ART)

Nevertheless, this may also lead to the bag tearing in an unclean manner because the upwardly pointing tit connections 116 may leave unsightly tails 118. FIG. 22*c* demonstrates what may happen if the rip does not follow the perforation but instead severs outwardly across the tab. Large, unsightly portions 120 of the tab stay attached to the bag.

For purposes of comparison, one may test the cleanness of the tear along the perforations by pulling each tested bag with minimum force of about five pounds maximum at the tit connection at the bag mouth of the bag body. The result of such a comparison test is set forth in the following Table III. Failures are listed for only those connections which induced a straight line tear, as opposed to a general tendency to want to tear or divert stress into the body of the bag at the tit connection location. At least every other tit connection on five different types of prior art bags having visible "standard" perforation tit connections (FIG. 21*a*) were tested. Also, three different bags with upwardly pointing tit connections" (FIG. 22*a*) were also tested. Finally, four types of bags with wave pattern perforated connections in accordance with the present invention (FIGS. 19–20) were tested.

TABLE III

| TEST # | DESCRIPTION | # OF ATTEMPTS | # OF FAILURES |
|---|---|---|---|
| Standard tit connections: | | | |
| A. | #20 dual tab Bottlesack bag | 12 | 6 |
| B. | Walgreens 10 × 3 × 17 | 25 | 10 |
| C. | *Walgreens 6 × 3 × 12 | 23 | 0 |
| D. | *Walgreens 6 × 3 × 12 | 21 | 13 |
| E. | #12 dual tab Bottlesack bag | 12 | 2 |
| | Totals | 94 | 32 |
| | | 33% failures | |
| Upwardly point tit connections: | | | |
| F. | #12 Bottlesack bag | 12 | 0 |
| G. | 11.5 × 4 × 21 Sears Bag | 12 | 3 |
| H. | *17 × 7.5 × 24 Sears Bag | 12 | 1 |
| | Totals | 36 | 4 |
| | | 11% failures | |
| Wave pattern connections: | | | |
| I. | Walgreens #12 | 16 | 0 |
| J. | Walgreens #12 | 16 | 0 |
| K. | #2 Bottlesack | 16 | 0 |
| L. | Safeway ⅙ Bbl sack | 8 | 0 |
| | Totals | 54 | 0 |
| | | 0% failures | |

* These two identical Walgreens bags were removed from the same wicket. The first (C) was from the bottom of the wicket and the second (D) was from the top of the wicket. Since the perforation cut is deeper at the top, the tit connections were more pronounced, hence the potential of tear was decidedly greater.

The upwardly pointing tit connections (FIG. 22*a*) surprisingly had three failures. This was due to the upwardly pointing tit connections, at times, creating a slight downwardly pointing dimple which caused tearing in response to stress, albeit far less frequently than the standard connections (FIG. 21*a*). To form the upwardly pointing tit connection, the die cut piece has to be bent to point severely upwards.

The wave pattern bags had no failures. They were less likely to tear than the "upwardly pointing tit connections" type in that they do not have to tear upwards to work. Wave pattern tit connections were found to tear far more cleanly and the cleaner cut is more pleasing aesthetically.

The previous embodiments have shown a stack of plastic bags contained within the carton. However, the carton may contain a different stack of items to be dispensed such as plastic sheet pick-up tissue typically used in bakeries or supermarkets for handling baked goods for customers, plastic sandwich and meat wrap in dells, or flower wraps.

While the foregoing description and drawings represent the preferred embodiments of the present invention, it will be understood that various changes and modifications may be made without departing from the spirit and scope of the present invention.

What is claimed is:

1. A dispenser useful for dispensing individual elements from a stack one at a time, each individual element having a mouth end and a tail end, the dispenser comprising:

a container having a body with top and front surfaces, said front surface being elongated between opposite end edges; and dispensing means for dispensing the individual elements from the stack one at a time from the container, said dispensing means including a cut-out opening extending between said top and front surfaces, said cut-out opening having a configuration in said top surface which allows for manual grasping of a top-most one the individual elements contained within the container, said cut-out being defined in said front surface by a bottom edge and two side edges each extending upwardly and outwardly from a respective side of said bottom edge so as to be configured for channeling a top-most one of the individual elements along the side edges when being dispensed, said dispensing means also including two slits each extending outwardly in a direction toward a respective one of said end edges of said front surface and terminating spaced therefrom, said slits each having a lower edge extending upwardly and outwardly from a respective one of said two side edges to which is channeled the top-most one of the individual elements as a result of the channeling from the side edges, said slits having a configuration which allows dispensement of the individual elements one at a time through the slits and which may block a subsequent individual element from being dispensed at the same time through the slits if the subsequent individual element clings to the top-most one of the individual elements during the dispensement.

2. A dispenser as in claim 1, wherein said stack of individual elements include any one of a stack of plastic bags and a stack of plastic sheets.

3. A dispenser as in claim 1, wherein said container body has an inclined lower surface extending downwardly from said bottom edge of said cut-out and in a direction towards a rear of the container.

4. A dispenser as in claim 1, further comprising the stack of individual elements which are packed tail forward within the container.

5. A dispenser as in claim 1, further comprising the stack of individual elements which are packed mouth forward within the container.

6. A dispenser containing a stack of bags, each bag having a mouth end and a tail end, said dispenser and stack of bags comprising:

a container having a body with top and front surfaces;

a stack of individual plastic bags packed tail forward within the container, each of said plastic bags having two edge configurations each extending from a top edge of said mouth to a respective side at a lower elevation than said top edge, said edge configurations each having a wave form pattern of peaks and valleys; and dispensing means for dispensing individual plastic bags from said stack one at a time from said container, said dispensing means including a cut-out opening extending between said top and front surfaces, said cut-out opening having a configuration in said top surface which allows for manual grasping of a top-most one of said plastic bags contained within said container, said cut-out being defined in said front surface by a bottom edge and two side edges each extending upwardly and outwardly from a respective side of said bottom edge so as to be configured for channeling a top-most one of said plastic bags along the side edges when being dispensed, said dispensing means also including two slits each extending outwardly and each having a lower edge extending upwardly and outwardly from a respective one of said two side edges to which is channeled the top-most one of said plastic bags as a result of the channeling from the side edges, said slits having a configuration which allows dispensement of individual plastic bags one at a time through the slits and which may block a subsequent individual plastic bag from being dispensed at the same time through the slits if the subsequent individual plastic bag clings to the top-most one of said plastic bags during the dispensement.

7. A dispenser containing a stack of bags, each bag having a mouth end and a tail end, said dispenser and stack of bags comprising;

a container having a body with top and front surfaces;

a stack of plastic bags packed mouth forward within said container, each of said plastic bags having two edge configurations each extending from a top edge of said mouth to a respective side at a lower elevation than said top edge, said edge configurations each having a wave form pattern of peaks and valleys; and dispensing means for dispensing individual plastic bags from said stack one at a time from said container, said dispensing means including a cut-out opening extending between said top and front surfaces, said cut-out opening having a configuration in said top surface which allows for manual grasping of a top-most one of said plastic bags contained within said container, said cut-out being defined in said front surface by a bottom edge and two side edges each extending upwardly and outwardly from a respective side of said bottom edge so as to be configured for channeling a top-most one of said plastic bags along the side edges when being dispensed, said dispensing means also including two slits each extending outwardly and each having a lower edge extending upwardly and outwardly from a respective one of said two side edges to which is channeled the top-most one of said plastic bags as a result of the channeling from the side edges, said slits having a configuration which allows dispensement of individual plastic bags one at a time through the slits and which may block a subsequent individual plastic bag from being dispensed at the same time through the slits if the subsequent individual plastic bag clings to the top-most one of the individual plastic bags during the dispensement.

8. A dispenser containing a stack of bags, each bag having a body and two tabs extending from opposite sides of said body with perforations extending between said tabs and said body in a wave pattern, said dispenser and stack of bags comprising:

a container having a body with top and front surfaces;

dispensing means for dispensing individual bags from said stack one at a time from said container, said dispensing means including a cut-out opening extending between said top and front surfaces, said cut-out opening having a configuration in said top surface which allows for manual grasping of a top-most one of said bags contained within said container, said cut-out being defined in said front surface by a bottom edge and two side edges each extending upwardly and outwardly from a respective side of said bottom edge so as to be configured for channeling a top-most one of said bags along the side edges when being dispensed, said dispensing means also including two slits each extending outwardly and each having a lower edge extending upwardly including two slits each extending outwardly and each having a lower edge extending upwardly and outwardly from a respective one of said two side edges to which is channeled the top-most one of said bags as a result of the channeling from the side edges, said slits having a configuration which allows dispensement of individual bags one at a time through the slits and which may block a subsequent individual bag from being dispensed at the same time through the slits if the subsequent individual bag clings to the top-most one of said bags during the dispensement; and means for attaching said tabs to said container, said perforations being arranged to sever in response to manual pulling of the body relative to said tabs.

9. A dispenser as in claim 8, wherein said wave pattern resembles any one of the patterns selected from the group consisting of a sinusoidal pattern, a saw tooth pattern and a scalloped pattern.

10. A dispenser as in claim 8, wherein said individual elements each have a top edge, two sides and two tabs, said tabs being bounded by perforations which extend from the top edge of said individual elements to respective ones of said sides.

11. A dispenser as in claim 1, wherein the container is composed of a material selected from the group consisting of cardboard, metal and plastic.

12. A dispenser as in claim 1, wherein each of said slits has a top edge which extends substantially parallel to an edge of the container between the top and front surfaces and has a lower edge which inclines from said opening toward an end of said top edge most distal from said opening.

13. A dispenser as in claim 1, wherein each of said slits tapers from said cut-out opening.

14. A dispenser as in claim 1, wherein said side edges of said cut-out have a wave pattern.

15. A dispenser as in claim 14, wherein the wave pattern resembles any one of a saw tooth pattern, a sinusoidal pattern and a scalloped pattern.

16. A dispenser as in claim 1, further comprising a ramp inclining downwardly from the bottom edge of said cut-out opening towards a rear of the container, said stack resting on said ramp.

17. A dispenser containing a stack of bags, said dispenser and stack of bags comprising:

a container having a body with top and front surfaces;

dispensing means for dispensing individual bags from the stack one at a time from said container, said dispensing means including a cut-out opening extending between said top and front surfaces, said cut-out opening having a configuration in said top surface which allows for manual grasping of a top-most one of said bags contained within said container, said cut-out being defined in said front surface by a bottom edge and two side edges each extending upwardly and outwardly from a respective side of said bottom edge so as to be configured for channeling a top-most one of said bags along the side edges when being dispensed, said dispensing means also including two slits each extending outwardly and each having a lower edge extending upwardly and outwardly from a respective one of said two side edges to which is channeled the top-most one of said bags as a result of the channeling from the side edges, said slits having a configuration which allows dispensement of individual bags one at a time through the slits and which may block a subsequent individual bag from being dispensed at the same time through the slits if the subsequent individual bag clings to the top-most one of said bags during the dispensement; and a ramp inclining downwardly from the bottom edge of said cut-out opening towards a rear of the container, said stack resting on said ramp, said stack of bags being a stack of T-shirt style plastic bags each having a body with a mouth and two strap handles extending upwardly from said body beyond an elevation of said mouth, said strap handles being folded within said container at a junction with said mouth, said body being folded within said container adjacent a rear of the container so that said strap handles extend, as a result of being folded, toward tail ends of said bags.

18. A dispenser as in claim 1, further comprising the stack of individual elements which are a stack of plastic bags each folded within the container.

* * * * *